US009120604B2

(12) United States Patent
Löhn

(10) Patent No.: US 9,120,604 B2
(45) Date of Patent: Sep. 1, 2015

(54) DRINKING CONTAINER WITH A DRINKING VESSEL AND A DRINKING CAP

(71) Applicant: MAPA GmbH, Zeven (DE)

(72) Inventor: Jürgen Löhn, Groβ Meckelsen (DE)

(73) Assignee: MAPA GmbH, Zeven (DE)

( * ) Notice: Subject to any disclaimer, the term of this patent is extended or adjusted under 35 U.S.C. 154(b) by 0 days.

(21) Appl. No.: 14/297,317

(22) Filed: Jun. 5, 2014

(65) Prior Publication Data

US 2015/0069065 A1 Mar. 12, 2015

(30) Foreign Application Priority Data

Jun. 24, 2013 (DE) ..... 10 2013 010 431

(51) Int. Cl.

| | |
|---|---|
| ***B65D 47/24*** | (2006.01) |
| ***A61J 9/04*** | (2006.01) |
| ***A47G 19/22*** | (2006.01) |
| ***B65D 51/16*** | (2006.01) |

(52) U.S. Cl.

CPC ..... *B65D 47/248* (2013.01); *A47G 19/2272* (2013.01); *A61J 9/04* (2013.01); *B65D 51/1611* (2013.01)

(58) Field of Classification Search

CPC ..... B65D 51/165; B65D 51/1644; B65D 51/1633; B65D 51/1611; B65D 51/1605; B65D 51/16; B65D 51/1622; B65D 47/248; B65D 47/244; B65D 47/24; B65B 31/046; B65B 31/04; A61J 9/04; A61J 11/04; A61J 11/02; A47G 19/2272; A47G 19/2266; A47G 19/2205; A47G 19/22

USPC ..... 220/374, 373, 367.1, 709, 705, 713, 220/714, 711; 215/11.5, 11.4, 11.6, 311, 215/310, 307; 222/568, 567, 566, 562, 222/189.09

See application file for complete search history.

(56) References Cited

U.S. PATENT DOCUMENTS

| | | | |
|---|---|---|---|
| 2,737,180 | A | 3/1956 | Perreault |
| 2005/0006415 | A1 | 1/2005 | Kiehne |

FOREIGN PATENT DOCUMENTS

| | | | |
|---|---|---|---|
| FR | 2 548 894 | A1 | 1/1985 |

*Primary Examiner* — Robert J Hicks

(74) *Attorney, Agent, or Firm* — Vidas, Arrett & Steinkraus, P.A.

(57) ABSTRACT

A drinking container with a drinking vessel, a drinking cap and a threaded ring. The drinking vessel has an inner space, a circular vessel opening, an opening edge surrounding the vessel opening and an external thread next to the vessel opening. The drinking cap has a bottom wall, a ring flange surrounding the bottom wall for abutment on the opening edge of the drinking vessel, a drinking element protruding outwards from the bottom wall and a valve for sealing and opening a passage from the inner space to the outside of the mouthpiece, which is openable for drinking and otherwise closable. A ventilation channel is present in the bottom side of the ring flange or in the top side of the opening edge.

16 Claims, 12 Drawing Sheets

DRINKING CONTAINER WITH A DRINKING VESSEL AND A DRINKING CAP

CROSS-REFERENCE TO RELATED APPLICATIONS

This Utility Patent Application claims priority to DE 10 2013 010 431.9, filed on Jun. 24, 2013, the entire contents of which is incorporated herein by reference.

STATEMENT REGARDING FEDERALLY SPONSORED RESEARCH

Not applicable.

BACKGROUND OF THE INVENTION

The invention relates to a drinking container with a drinking vessel and a drinking cap. The drinking vessel is preferably a drinking bottle or a drinking cup and the drinking cap is preferably a drinking spout, a push/pull drinking cap, a drinking straw drinking cap or a drinking suction nozzle.

Drinking caps have a bottom wall, a ring flange surrounding the bottom wall for fastening on the opening edge of the drinking vessel by means of a fastening ring and a mouthpiece protruding outward from the bottom wall with at least one drinking opening on the outside. The drinking opening is connected with the inside of the mouthpiece via a passage. By sucking on the mouthpiece during drinking, negative pressure is created in the drinking vessel, which must be relieved. Drinking caps have ventilation valves for this reason.

In the case of a design of the drinking cap as a drinking suction nozzle, a suction nozzle is connected with the ring flange via a suction spout. The drinking suction nozzle is produced as a single piece made of an elastomer material. The drinking opening is a hole or a slit or several holes or slits in the upper end of the suction part. For ventilation, for example, a slit valve is present on the circumference of the suction spout, which opens when there is negative pressure in the drinking bottle. Radial grooves on the bottom side of the ring flange, through which air can flow between the ring flange and the opening edge of the drinking vessel, are also known.

Seals of drinking suction nozzles on drinking bottles are also known, in which slightly different setting angles of the sealing surfaces in the case of light screwing do not lead to a full seal. In the case of this type of seal, one of the two sealing surfaces is generally made of a soft elastic material.

Drinking suction nozzles with a slit valve are complex to produce. Grooves in the sealing surface progressing outward radially are very short so that good ventilation is hardly compatible with a sufficient seal against the escape of liquid. Different torques of the threaded ring lead to different deformations of the ventilation grooves, which impair their function. In the case of different setting angles of the sealing surfaces, the production effort is high due to the soft component. Ventilation and sealing also depend greatly on the torque of the threaded ring in the case of these designs.

U.S. Pat. No. 2,737,180, the entire contents of which is incorporated herein by reference, describes a drinking suction nozzle made of flexible material, which is protected from collapsing by the negative suction pressure. For this, the drinking suction nozzle has a spiral channel in the bottom side of a fastening flange. The drinking suction nozzle is preferably formed from an elastic material or synthetic rubber as well as silicone rubber. But it can also be made of plastic materials with the same elastic properties, as well as for example of PVC.

Due to the elasticity, the air flow is changeable through the setting of the cross-section of the channel, in that a threaded ring is screwed tighter on a drinking bottle for the fixing of the fastening flange. The changeability of the channel cross-section is promoted through the design of the channel between easily deformable ribs. The small cross-section of the channel and its length are to prevent the escape of liquid.

FR 2 548 894 A1, the entire contents of which is incorporated herein by reference, describes a one-piece drinking suction nozzle made of a soft elastomer. The drinking suction nozzle has several channels, which have the shape of a spiral section and are designed as a groove in the bottom side of the flange. The spiral sections each extend around their common center by approximately 240°. The channels should let air easily flow through when there is negative pressure in the drinking bottle and prevent the escape of liquid. Also in the case of this drinking suction nozzle, the extent of ventilation and prevention of escape of liquid also depends on the torque exerted on the threaded ring.

The known feeding suction nozzles with spiral channels have permanently open drinking openings so that a protection from the leaking of the tipped drinking bottle is not possible. The channels serve above all to ventilate the drinking bottles and prevent the collapse of the soft suction nozzle during drinking. In the case of a firmly tightened threaded ring, the channels are largely pressed together whereby the ventilation is greatly reduced. In order to also ensure this in the case of strong compression, the channels have a large cross-section. For this reason, a liquid escape is easily possible in the case of low torques.

Furthermore, drinking caps designed as a drinking spout are known. In the case of these drinking caps, the mouthpiece generally has an oval cross-section and is arranged eccentrically with respect to the ring flange. A suction valve, which opens when negative pressure is applied, is integrated into the mouthpiece. Furthermore, a ventilation valve, which opens when negative pressure builds up in the drinking vessel, is integrated into the bottom wall. Drinking spouts are leakproof due to the valves. The mouthpiece, bottom wall and ring flange are preferably designed as one piece of hard plastic (hard spout). There are also soft spouts, which are designed as one piece of silicone or natural rubber and have a slit valve in the mouthpiece and another slit valve for ventilation in the bottom wall. The high production effort is disadvantageous in the case of the known spouts.

Furthermore, drinking caps are known that are designed as a push/pull cap. It has a mouthpiece accessible from the outside, which is arranged in an axially shiftable manner in a mouthpiece holder that is connectable with the drinking container. The mouthpiece is moveable back and forth with the teeth or by hand between an opened and a closed position. Due to the fact that the hands are generally not needed to open and close the cap, these drinking caps are popular in particular in the field of sports, for leisure activities and on drinking containers for children. In simple designs, air flows in through the open mouthpiece, for which the user must put down the drinking bottle. In complex designs, air can flow in through a ventilation valve in the bottom wall of the mouthpiece holder.

Furthermore, drinking caps with a drinking straw are known. These have a drinking straw holder with a through hole, into which a drinking straw is inserted in a sealing manner. An upper part of the drinking straw sticks up beyond the top side of the drinking straw holder and a lower part protrudes into the drinking vessel from the bottom side of the drinking straw holder in order to extract the beverage from the drinking vessel while sucking on the top part. The drinking straw can be sealed for example through bending and fixing of the bent drinking straw by means of a cover clamped on the drinking straw holder. In addition or instead, a suction valve can be integrated into the drinking straw. The drinking straw can be supported via a conical flange on a cone in the bottom wall of the drinking straw holder. The cone of the bottom wall can be provided with ventilation holes. In the case of negative pressure in the drinking vessel, the flange of the drinking straw can be lifted from the ventilation holes so that air can flow in from outside. This requires the buildup of a high negative pressure.

BRIEF SUMMARY OF THE INVENTION

Against this background, an object of the invention is to create a less complex, leak-proof drinking container, which enables reliable ventilation and is leak-proof.

The drinking container according to the invention has a drinking vessel, a drinking cap and a threaded ring, wherein

- the drinking vessel has an inner space, a circular vessel opening, an opening edge surrounding the vessel opening and an external thread next to the vessel opening,
- the drinking cap has a bottom wall, a ring flange surrounding the bottom wall for abutment on the opening edge of the drinking vessel, a drinking element protruding outwards from the bottom wall and a sealing means for sealing and opening a passage from the inner space to the outside of the mouthpiece, which is openable for drinking and otherwise closable,
- a ventilation channel is present in the bottom side of the ring flange or in the top side of the opening edge, which extends from an inner channel opening lying further inside radially and open towards the inner space of the drinking vessel up to an outer channel opening lying further outside radially and open to the environment, surrounds the center of the vessel opening at least 0.75-fold between these two channel openings, has a cross-sectional surface in the range of 0.02 to 0.08 $mm^2$ and is designed in a rigid material with a modulus of elasticity of at least 0.2 $kN/mm^2$ and
- the ring flange is fixable in liquid-tight abutment on the opening edge by means of the threaded ring.

In the case of the drinking vessel according to the invention, leak tightness is ensured by the sealing means of the drinking cap and the ventilation channel, which extends both in the radial direction as well as in the circumferential direction of the vessel opening. Due to the fact that the ventilation channel has a cross-sectional surface in the range of 0.02 to 0.08 $mm^2$, sufficient ventilation is possible and an unhindered escape of liquid is avoided. The design of the ventilation channel in the bottom side of the ring flange or in the top side of the opening edge, which consists of a rigid material, prevents a compression of the ventilation channel during tightening of the threaded ring to an extent that the ventilation channel is mainly pressed together and sufficient ventilation is no longer possible. At least the bottom side of the ring flange and/or the top side of the opening edge consists of the rigid material. Preferably, the ring flange and/or at least the bottle neck of the drinking vessel consists of rigid material. Sufficient rigidity of the material is given in that it has a modulus of elasticity of at least 0.2 $kN/mm^2$.

When the ventilation channel surrounds the center of the vessel opening 0.75-fold, the container filled with beverage up to below the bottle neck only just does not flow out. In the case of a lying drinking container, namely at least one of the channel openings is located at least at the level of the liquid level so that the liquid does not flow out. According to a preferred embodiment, the ventilation channel progresses at least once around the center of the vessel opening. A flowing out is hereby prevented even when the drinking container is filled up to the opening edge. According to a preferred embodiment, which is protected even better from leaks, the ventilation channel extends multiple times, in particular 1.5-fold, around the center of the vessel opening. These embodiments can prevent in particular a liquid leak through the capillary action during wetting of the ventilation channel with liquid. In principle, the plastics used for the drinking vessel and drinking cap are not wetted by water or other beverages. Dishwashing liquid residue can however result in wetting. According to a preferred embodiment, the ventilation channel on the ring flange extends multiple times around the center of the opening edge. It is achieved through the ventilation channel surrounding it multiple times that a sufficient, effective length of the ventilation channel from the top side of the opening edge or respectively from the bottom side of the ring flange is covered even when the ring flange is not arranged exactly concentrically on the opening edge as a result of play between the ring flange and threaded ring. It can be ensured through several circulations of the ventilation channel around the center that the effective length of the ventilation channel always surrounds the center of the opening edge at least 0.75-fold, preferably 1.0-fold and further preferably 1.5-fold. The effective length of the ventilation channel preferably surrounds the center of the vessel opening at least 0.75-fold, further preferably at least 1.0-fold and further preferably 1.5-fold. The inner and outer channel openings are located at points where the ventilation channel is not yet covered by the opening edge or by the ring flange. The information in the claims on the circulations of the ventilation channel around the center of the opening edge relate to the effective length of the ventilation channel. This is the section of the ventilation channel which is covered on the bottom by the opening edge or on the top by the ring flange.

According to a preferred embodiment, the ventilation channel progresses around the center of the vessel opening at a maximum 10-fold, further preferably at a maximum 7.5-fold, further preferably at a maximum 5-fold, further preferably 2.5-fold.

The ventilation channel ensures sufficient liquid tightness, which prevents a flowing or dripping out of liquid when the drinking container tips over. It is understood that absolute liquid tightness is not striven for here, since the flowing out of individual drops of liquid can be achieved over time from the ventilation channel, e.g. through intensive shaking, holding the drinking container with the drinking cap facing down, if applicable both at the same time, which is however insignificant in practice.

The modulus of elasticity is preferably at least 0.2 $kN/mm^2$, further preferably at least 0.5 $kN/mm^2$, further preferably at least 1 $kN/mm^2$ According to a preferred embodiment, the modulus of elasticity is established in the range from 1 to 2 $kN/mm^2$.

According to one embodiment, the ventilation channel has a cross-sectional surface of 0.03 to 0.06 $mm^2$, preferably in the range of 0.04 to 0.05 $mm^2$ In these ranges, the suction pressure to be overcome during drinking and the leak rate have beneficial values. These values are particularly beneficial when the ventilation channel extends in the circumferential direction around the center of the vessel opening 1- to 1.5-fold.

According to a preferred embodiment, the cross-sectional surface of the ventilation channel has the same size everywhere, which is established within the required range. But the invention also relates to embodiments in which the size of the cross-sectional surface varies along the ventilation channel. A variable size of the cross-sectional surface can be provided for example in order to counteract the capillary action. For this, for example the ventilation channel can have a larger cross-section in the areas adjacent to the channel opening than in the other areas.

According to further embodiment, the ventilation channel has a spiral or a meandering or a labyrinth-like progression around the center of the ring flange. Other progressions as well as combinations of the named progressions of the ventilation channel are also possible. In particular, the ventilation channel can have several channel sections, which progress around the center of the vessel opening with different radii and are connected with one another through one or more radially progressing channel sections. Furthermore, the ventilation channel can have progressions, the middle point of which lies outside the center of the vessel opening. Furthermore, the ventilation channel can have several inner channel openings and/or several outer channel openings. However, it preferably has only one single inner and one single outer channel opening.

According to its design, the ventilation channel has a depth of 0.1 to 0.25 mm, preferably 0.15 to 0.17 mm. According to a further embodiment, the ventilation channel has a width of 0.35 to 0.55 mm, preferably 0.45 to 0.5 mm. Ventilation channels with dimensions in the named ranges are advantageous in terms of production. This applies in particular when the support of the ventilation channel is injection-molded from plastic. Moreover, in the case of the widespread drinking vessels with a width of the opening edge in the range of 0.8 to 2.5 mm and an outer diameter in the range of 30 to 70 mm, preferably from 35 to 50 mm, a sufficiently wide carrying area remains on the bottom side of the ring flange or on the top side of the opening edge, which is not damaged during the tightening of the threaded ring with an assumable torque. The assumable torque is 1.75 Nm as per standard. Drinking containers according to the invention are preferably designed such that they withstand greater torques without damaging the carrying area, e.g. a multiple of 1.75 Nm, in particular 3.5, the double, triple or quadruple.

The cross-sectional surface of the ventilation channel can generally have any shape (e.g. rectangular, triangular, trapezoidal or bell-shaped). However, the cross-section preferably extends to the bottom side of the ring flange or respectively to the top side of the opening edge (e.g. triangular or trapezoidal) in order to facilitate the demolding during injection molding. The ventilation channel preferably has a belt-shaped cross-sectional geometry due to the production-caused radii of the injection-molding tools.

According to a further embodiment, the carrying region between two neighboring channel sections of the ventilation channel has a width of at least 0.2 mm preferably of at least 0.25 mm, preferably in the range of 0.3 to 0.35 mm. In the case of these widths, the carrying region is protected from damage due to tightening of the threaded ring at the assumable torque (of 1.75 Nm or more). This is in particular the case when the ventilation channel is made of a plastic.

The ventilation channel is preferably a groove in the bottom side of the ring flange or in the top side of the opening edge. The design of the ventilation channel is advantageous for carrying areas with a width which is sufficiently stable with respect to damage. Alternatively, the ventilation channel is preferably between ribs on the bottom side of the ring flange or in the top side of the opening edge.

According to a preferred embodiment, the opening edge has a width of 0.8 to 2.5 mm. In the case of drinking vessels made of plastic, the opening edge preferably has a width of 1.0 to 2.5 mm. In the case of drinking vessels made of steel or another metal, it can also have a width of 0.8 mm.

According to a further embodiment, the bottom side of the ring flange and/or the top side of the opening edge has a roughness which reduces the capillary action despite dishwashing liquid-containing residue. As already mentioned, plastics from which drinking vessels and drinking caps are normally made are not wetted by water and other beverages, i.e. the contact angle of the liquid on an even surface of the material is greater than 90°. Under these conditions, liquid does not rise in the ventilation channel due to capillary action. However, if dishwashing liquid residue remains on the surface, the liquid can wet it, i.e. the contact angle is less than 90°. In the case of this embodiment, this is counteracted by a roughness of the surface, which prevents a wetting with liquid and thus a capillary action. According to one embodiment, this roughness is created in that the ring flange or respectively the entire drinking cap or the opening edge or respectively the entire drinking vessel is injection-molded by means of an injection molding-tool, which is produced through milling, turning or eroding. With the injection-molding tools produced in this manner, drinking caps with ring flanges and drinking vessels with opening edges can be produced, the roughness of which reduces a wetting with liquid even in the presence of dishwashing-liquid residue. Since this effect can be removed through later polishing of the tools, they are preferably used unpolished.

According to a further embodiment, the ring flange and the opening edge are circular disk-shaped or conical or spherical shell-shaped. Any combinations of these geometries are also possible.

According to a preferred embodiment, the ventilation channel is integrated directly into the bottom side of the ring flange connected as one piece with the bottom wall. According to another embodiment, the ventilation channel is integrated into the bottom side of a separate ring flange, which is clampable between the ring flange connected as one piece with the bottom wall and the opening edge. According to another embodiment, the ventilation channel is integrated directly into the top side of the opening edge connected as one piece with the drinking vessel. According to another embodiment, the ventilation channel is integrated into the top side of a separate, ring disk-shaped opening edge, which is clampable between the opening edge connected as one piece with the drinking vessel and the ring flange.

According to a further embodiment, the drinking vessel is a drinking bottle or a drinking cup.

According to a further embodiment, the drinking cap is a drinking spout (soft spout or hard spout) or a drinking cap with a push/pull valve or a drinking cap with a drinking straw or a drinking suction nozzle.

In the case of a drinking spout, the drinking element is a mouthpiece. The sealing means in a drinking spout is preferably a valve, which is arranged in the passage. The valve is preferably a membrane valve, which automatically opens when negative pressure is established on the mouthpiece and otherwise closes. In the case of a soft spout, the mouthpiece and, if applicable, the bottom wall are made of a soft elastic material and, in the case of a hard spout, the mouthpiece and, if applicable, the bottom wall are made of a rigid material. The bottom wall or respectively the mouthpiece can be made of the same rigid material as the ring flange.

In the case of a drinking cap with a push/pull valve, the drinking element is also a mouthpiece, which is axially displaceable into a mouthpiece holder of the drinking cap. The sealing means is formed by the mouthpiece and additional sealing elements, which the mouthpiece holder has. The sealing means are opened and closed through axial displacement of the mouthpiece in the mouthpiece holder. In the case of the drinking cap with push/pull valve, the mouthpiece can be made of a soft elastic material or of a rigid material and the bottom wall with the mouthpiece holder of a rigid material. The mouthpiece or respectively the bottom wall can be made of the same rigid material as the ring flange.

In the case of a drinking cap with a drinking straw, the drinking element is the drinking straw or respectively the part of the drinking straw protruding outward from the drinking cap. The sealing means comprises a means for holding the drinking straw in a bent position, in which the drinking straw no longer lets liquid pass through. It is formed for example by a cover clampable on the threaded ring or the drinking cap, which holds the drinking straw in the bent position. In addition or alternatively, the sealing means is a valve integrated into the drinking straw, which opens when negative pressure is established on the upper part of the straw and closes when ambient pressure is established. In the case of the drinking cap with a drinking straw, the drinking straw can be made of a soft elastic material and the bottom wall with a drinking straw holder for holding the drinking straw can be made of a rigid material. The bottom wall with the drinking straw holder can be made in particular of the same rigid material as the ring flange.

In the case of a drinking suction nozzle, the drinking element is a suction nozzle, which is connected with the ring flange via a bottom wall in the form of a suction spout. The ring flange is made of the rigid material and the suction nozzle and, if applicable, the suction spout of silicone, natural rubber, thermoplastic elastomer or of another material softer than the ring flange. The sealing means is a slit valve consisting of one or more slits on the end of the suction nozzle.

According to a preferred embodiment, the entire drinking vessel and/or at least the ring flange and the bottom wall of the drinking cap are made of the rigid material with the modulus of elasticity of 0.2 $kN/mm^2$.

According to a further embodiment, the ring flange and/or the opening edge is made of polypropylene or polyethylene or of polypropylene with additives of thermoplastic elastomer or of another thermoplast or of a vulcanized rubber or of a hard-set thermoplastic elastomer with a rigidity like polypropylene or polyethylene or of metal or of any combination of the named materials.

According to a further embodiment, the ring flange and the bottom wall are made of one of the named materials. According to a further embodiment, the entire drinking vessel is made of one of the named materials.

BRIEF DESCRIPTION OF THE SEVERAL VIEWS OF THE DRAWINGS

The invention will be further explained below with reference to the accompanying drawings of exemplary embodiments. The drawings show.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated In the present patent application, the terms "top" and "bottom" refer to the orientation of the drinking container, in which the drinking vessel is arranged on the bottom and the drinking cap on the top.

Furthermore, in the case of the following explanation of different exemplary embodiments, the same parts are provided with corresponding reference numbers.

Figure 1:
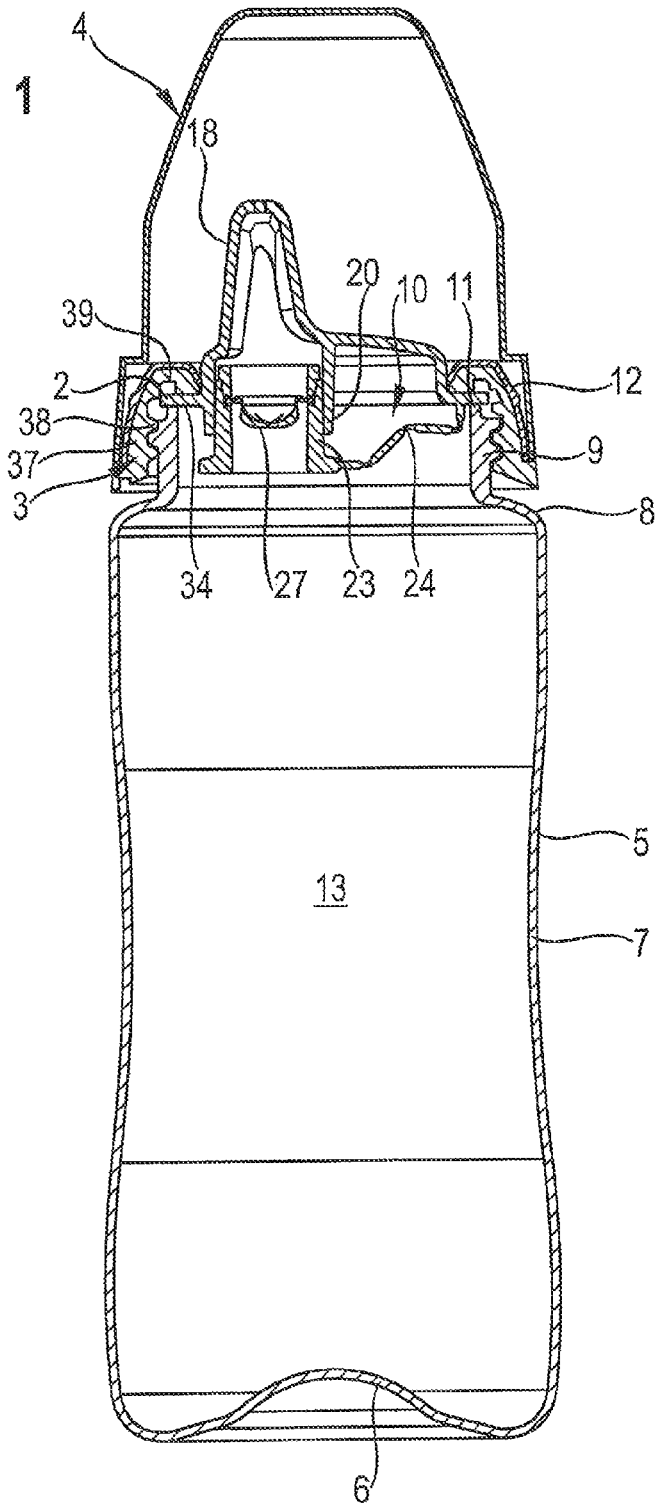
FIG. 1: drinking container with a hard drinking spout (hard spout) in a vertical cut.

The drinking container in FIG. 1 has a drinking vessel 1 in the form of a drinking bottle, a drinking cap 2 in the form of a hard drinking spout, a threaded ring 3 and a closing cap 4.

The drinking vessel 1 has an elongated bottle body 5 with a bottle bottom 6 and a sleeve-like bottle side wall 7. On the upper end of the bottle side wall 7, the drinking vessel 1 has a shoulder 8 from the inner circumference of which a cylindrical bottle neck 9 sticks up. The bottle neck 9 surrounds a circular vessel opening 10.

The upper front surface of the bottle neck 9 forms a circular ring disk-shaped opening edge 11, which surrounds the vessel opening 10. The bottle neck 9 carries an external thread 12 on the outer perimeter.

The drinking vessel 1 defines an inner space 13, which can be filled with a beverage.

FIGS. 2 to 6 are referenced for details on the drinking cap 2.

The drinking cap 2 has a circular ring disk-shaped ring flange 14. It is connected with a dome-shaped bottom wall 15 on its circumferential, inner edge. The bottom wall 15 has a cylindrical outer edge section 16 and an upwards curving middle section 17. A mouthpiece 18, which tapers gradually upwards, protrudes upwards from the middle section 17 of the bottom wall 15. The mouthpiece 18 is mainly conical and has an oval shape in the top view (see FIG. 4) and in every horizontal cut. The mouthpiece 18 is arranged eccentrically on the middle section 17 at a short distance from the edge section 16.

The middle section 17 does not extend below the mouthpiece 18 so that the interior of the mouthpiece 18 is accessible from the bottom side of the drinking cap 2. The middle section 17 forms a small inner step 19 between the mouthpiece 18 and the edge section 16.

A sleeve-like valve holder 20 protrudes downwards from the bottom side of the bottom wall. The valve holder 20 is arranged below the mouthpiece 18, wherein the mouthpiece 18 opens into the valve holder 20. The wall of the valve holder 20 coincides with the edge section 16 in a circumferential section. The valve holder 20 protrudes downwards with respect to the ring flange 14.

The valve holder 20 has on the inside a contour tapering upwards slightly conically.

The mouthpiece 18 is flattened on the top end. It has a drinking opening 21 there, which is formed by three parallel drinking holes. The drinking cap 2 has a passage 22, which extends from the drinking opening 21 up to the lower end of the valve holder 20.

A mainly sleeve-like valve housing 23 is connected as one piece with the bottom side of the ring flange 14 via a film hinge 24. The ring flange 14 has a section protruding radially beyond the connection of the film hinge 24. The valve housing 23 has on the outside a slightly conical outer contour, which matches the inner contour of the valve holder 20 so that the valve housing 23 is pivotable into the valve holder 20 by pivoting around the film hinge 24. According to FIGS. 4 and 5, the valve housing 23 has two protruding flaps 25, 26 on the sides, which facilitate the gripping of the valve housing 23.

A hat-like valve 27 made of silicone or of another soft elastic material is held in the valve housing 23. The valve 27 has a circular ring disk-shaped, circumferential valve edge 28, against which it rests on an inner step 29 of the valve housing 23. A ring 30 inserted into the valve housing 23 and fixed in it e.g. through shrink-wrapping holds the valve 27 in the valve housing 23. In a floor 31 curving downwards in the installed state, the valve 27 has two conically arranged slits 32, 33, which open when negative pressure is established and otherwise close.

In the installed state, the valve 27 is arranged in the passage 22 of the drinking cap 2.

Figure 2:
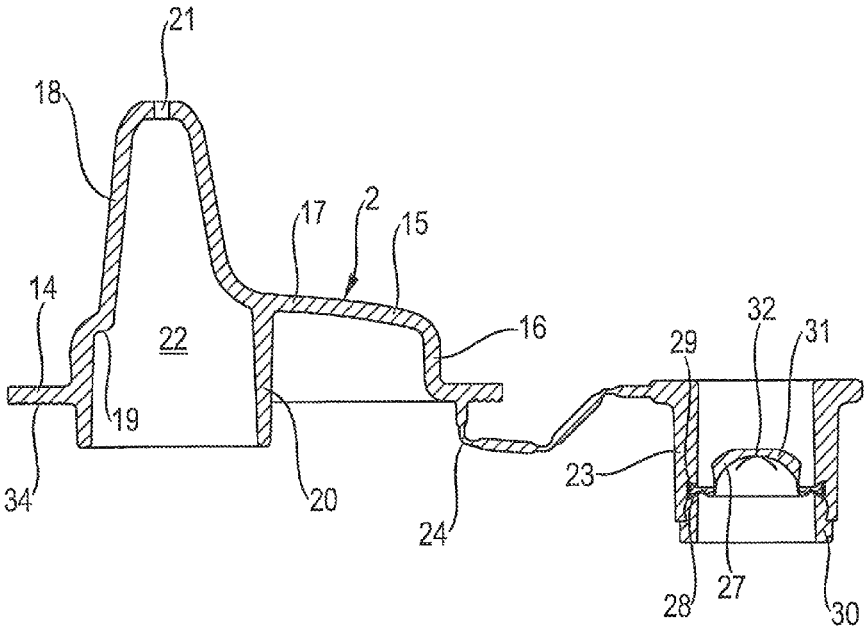
FIG. 2: the drinking spout with the valve housing pivoted out in an enlarged vertical cut.
Figure 3:
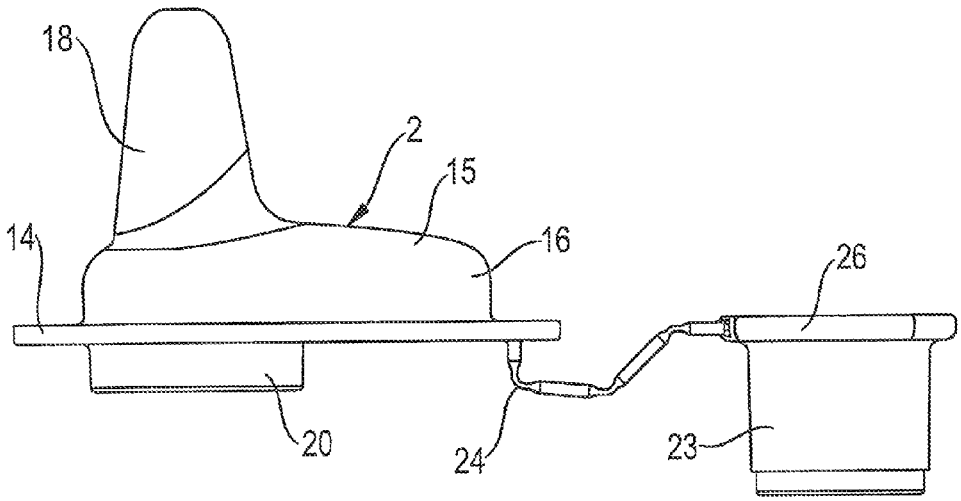
FIG. 3: the same drinking spout in a front view.
Figure 4:
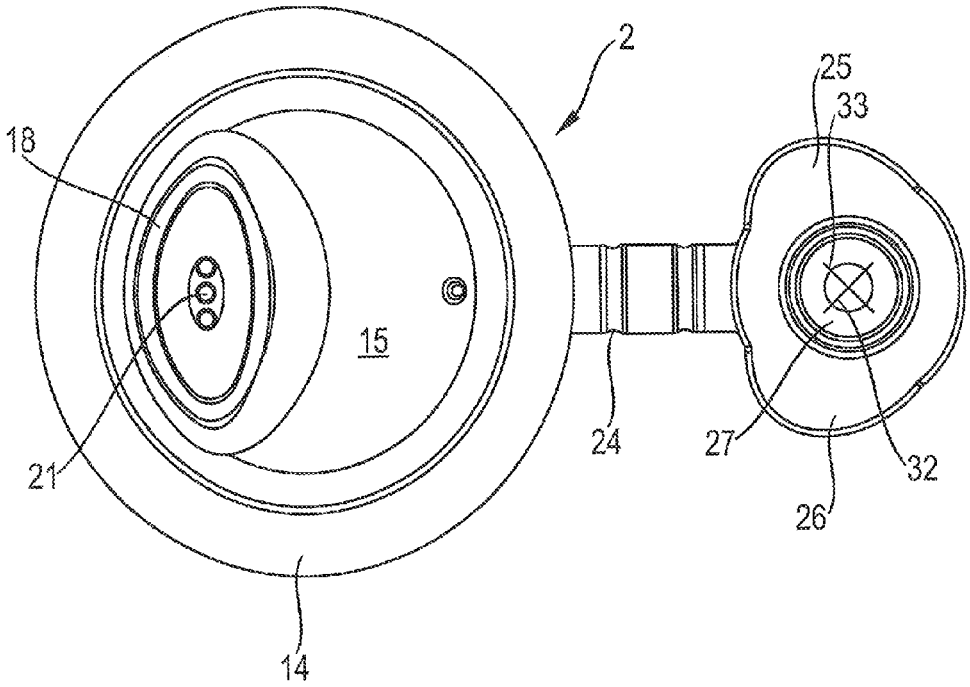
FIG. 4: the same drinking spout in a top view.
Figure 5:
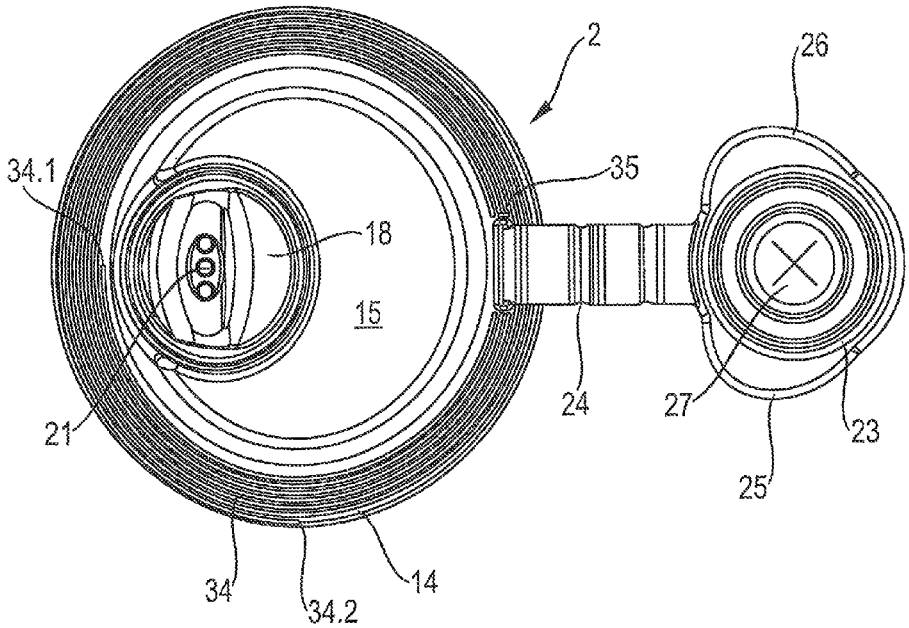
FIG. 5: the same drinking spout in a bottom view.
Figure 6:
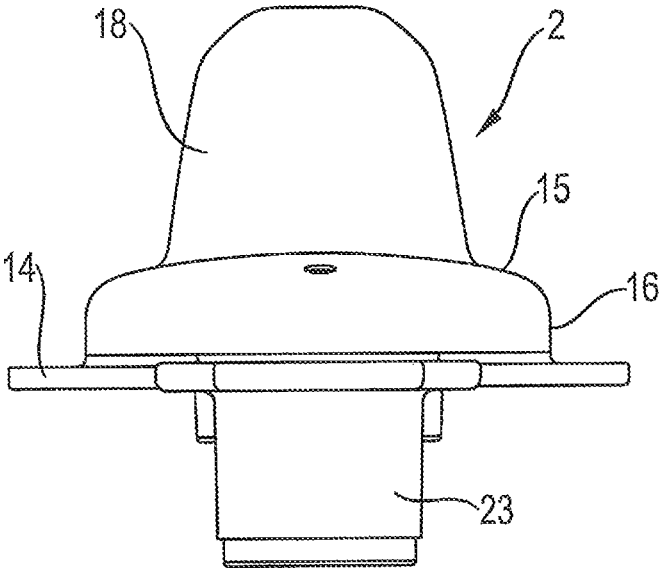
FIG. 6: the same drinking spout in a side view from the right.
Figure 7:
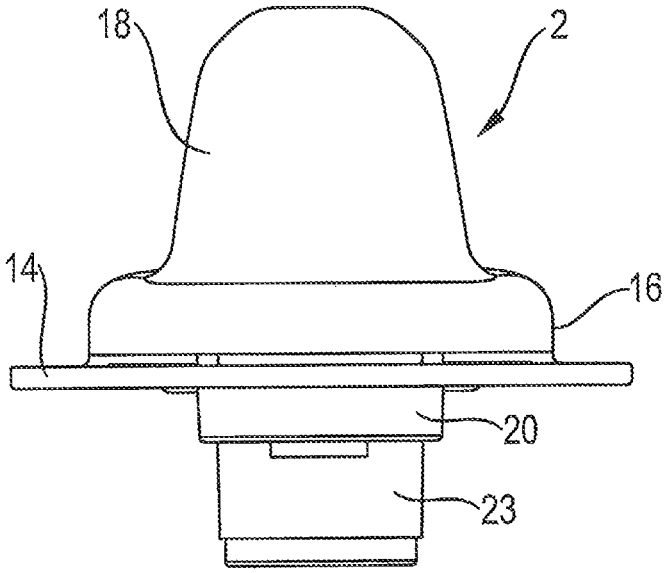
FIG. 7: the same drinking spout in a side view from the left.

On the bottom side of the ring flange 14, a spirally circumferential ventilation channel 34 is arranged outside of the connection of the film hinge (see FIGS. 2 and 5). In the area of the connection of the film hinge 24, neighboring coils of the ventilation channel 34 are interconnected by a radial channel section 35 in order to bridge the break by the connection. The ventilation channel 34 is designed as a groove in the bottom side of the ring flange 14.

The ventilation channel 34 has a constructive inner channel opening 34.1 and a constructive outer channel opening 34.2. The maximum width of the opening edge 11, on which the drinking cap 2 is mountable, is measured such that the inner channel opening 34.1 and the outer channel opening 34.2 barely remain free. The mounting of the drinking cap 2 on opening edges 11 with a smaller width is preferred because the long ventilation channel still comes free on both ends of the opening edge 11 due to its large length. The actually effective inner and outer channel openings are respectively located at points where the ventilation channel is not covered by the opening edge 11.

The drinking cap 2 consists of polypropylene or another polyolefin preferably with additives of a thermoplastic elastomer.

The drinking vessel 1 and the threaded ring 3 are made for example of polypropylene or of another polyolefin or of polyamide.

According to FIG. 1, the drinking cap 2 is placed with the bottom side of the ring flange 14 onto the opening edge 11 so that the channel sections of the ventilation channel 34, which are located outside the connection of the film hinge 24, rest on the opening edge 11. The film hinge 24, the valve holder 20 and the valve housing 23 protrude into the bottle neck. In this position, the drinking cap 2 is fixed on the drinking vessel 29 by the threaded ring 2.

For this, the threaded ring 3 has an almost cylindrical casing 37 with an internal thread 38 and a press flange 39 protruding inwards from the upper edge of the casing, which rests on the top side of the ring flange 14. The press flange 39 borders a central opening, through which the bottom wall 15 sticks up.

The ring flange 14 is pressed against the opening edge 11 by screwing tight the threaded ring 3.

During the tightening of the threaded ring 3 by hand, the ventilation channel 34 is not or only insignificantly deformed. When the user sucks on the mouthpiece 18, the valve 27 opens and the beverage flows out of the inner space 13 of the drinking vessel 1 through the passage 2. The inner space 13 of the drinking vessel 1 is hereby ventilated by the ventilation channel 34. The air can flow in between the internal thread 38 and the external thread 12 since there are sufficient ventilation gaps there. If necessary, the threaded ring 3 can be ventilated by an additional ventilation hole, which extends from the inside to the outside of the threaded ring 3 in the area arranged next to the bottom side of the ring flange 14.

The closing cap 4 is clamped onto the outside of the threaded ring 3. It is supported on a protruding edge on the bottom side of the threaded ring 3. The closing cap 4 protects the drinking cap 2 from contamination when it is not being used.

Figure 8:
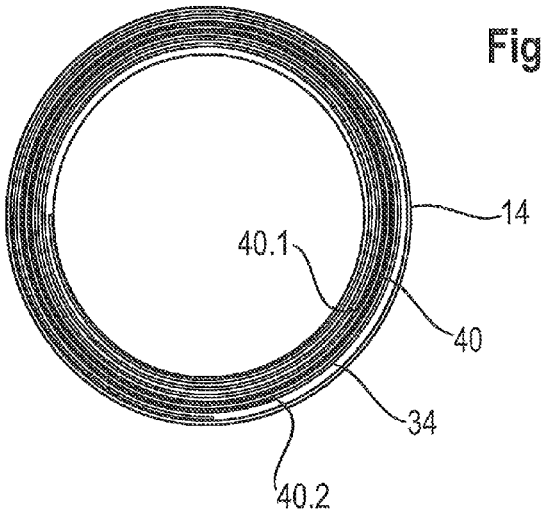
FIG. 8: the ventilation channel in the ring flange of the drinking spout with the effective part shaded in a dark color in a bottom view.
Figure 9:
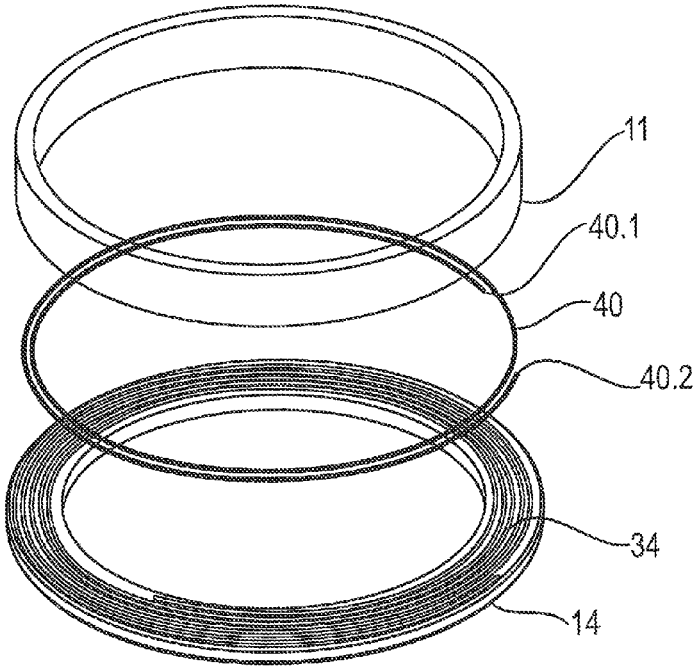
FIG. 9: the ventilation channel in the bottom side of the ring flange of the drinking spout with the upper section of the opening edge of the bottle and the effective part of the ventilation channel in between in a perspective view diagonally from the bottom and from the side.

According to FIGS. 8 and 9, only one section of the ventilation channel of the mounted drinking cap 2 is covered by the opening edge 11. This section borders the effective length 40 of the ventilation channel 34. In the example, the effective length of the ventilation channel 34 extends almost twice around the center of the vessel opening 10. The inner channel opening 40.1 is located on the inner end of the effective length 40 of the ventilation channel 34 and the outer channel opening 40.2 on the outer end.

Figure 10:
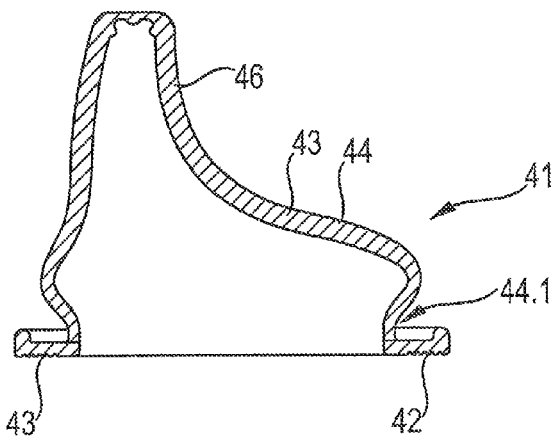
FIG. 10: a soft drinking spout (soft spout) in a vertical cut.
Figure 11:
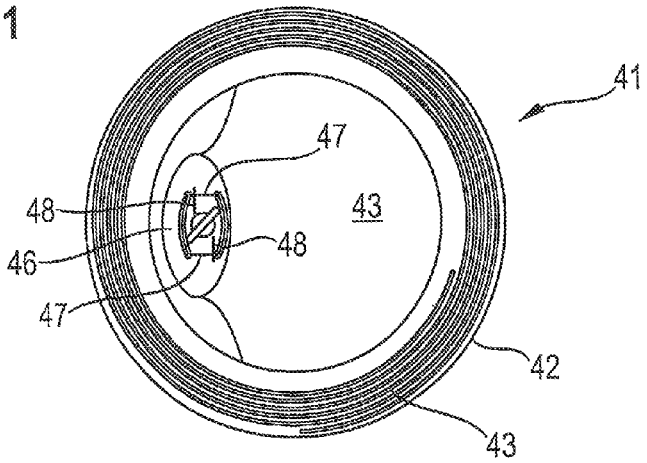
FIG. 11: the same drinking spout in a bottom view.

The drinking spout 41 in FIGS. 10 and 11 has a circular-cylindrical ring flange 42 with a spiral ventilation channel 43 in the form of a groove on the bottom side. The inner edge of the ring flange 42 is connected with a bottom wall 44. It has a constriction 44.1 adjacent to the ring flange 42 and a transition area 45 above this. The transition area 45 ends in an eccentrically arranged mouthpiece 46. The mouthpiece 46 has several drinking openings in the form of crossing drinking slits 47, 48 in a flattened end.

Such a drinking spout 41 is described in EP 1 924 234 B1. The contents of this patent are included in the present application by means of reference. In contrast to the known drinking spout, the drinking spout according to the invention has a ring flange 42 with a ventilation channel 43 on the bottom side and the ring flange 42 is made of a rigid material with a modulus of elasticity of at least 0.2 $kN/mm^2$ In the case of the drinking spout 41, the mouthpiece 46 and the bottom wall 44 are preferably made of natural rubber or silicone or a thermoplastic elastomer to match the patent named above in order to realize a soft spout.

The mouthpiece 46 and the bottom wall 44 are connected for example in a form-fitting and/or positively-fitting and/or force-fitting manner with the ring flange 42. For this, the bottom wall 44 and the ring flange 42 can have engaging contours. Furthermore, mouthpiece 46, bottom wall 44 and ring flange 42 can consist of cross-linked or cross-fused materials, for example the mouthpiece 46 and the bottom wall 44 of a thermoplastic elastomer and the ring flange 42 of polypropylene or polyethylene with additives of thermoplastic elastomer. In the case of a form-fitting connection, for example the bottom wall 44 on the outer edge and/or the ring flange 42 on the inner edge has clamping means for clamping the respective other part.

The drinking spout 41 is fixable on the drinking vessel 1 in FIG. 1 by means of the threaded ring 3. The drinking slots 47, 48 of the mouthpiece 46 open due to the negative pressure during drinking and liquid can escape. Air can flow in through the spiral ventilation channel 43. If there is no negative pressure at the mouthpiece 46, the drinking slots 47, 48 close automatically. The discharge of liquid is prevented by the closed slits 47, 48 and the ventilation channel 43, even when the drinking container tips over.

Figure 12:
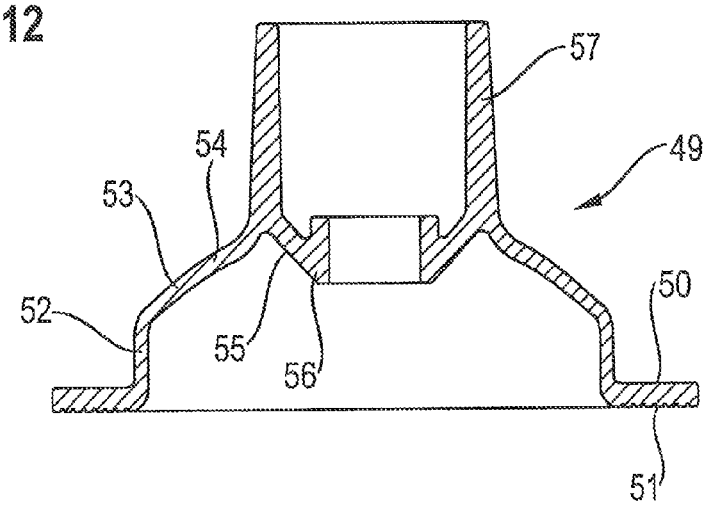
FIG. 12: a drinking straw holder in a vertical cut.
Figure 13:
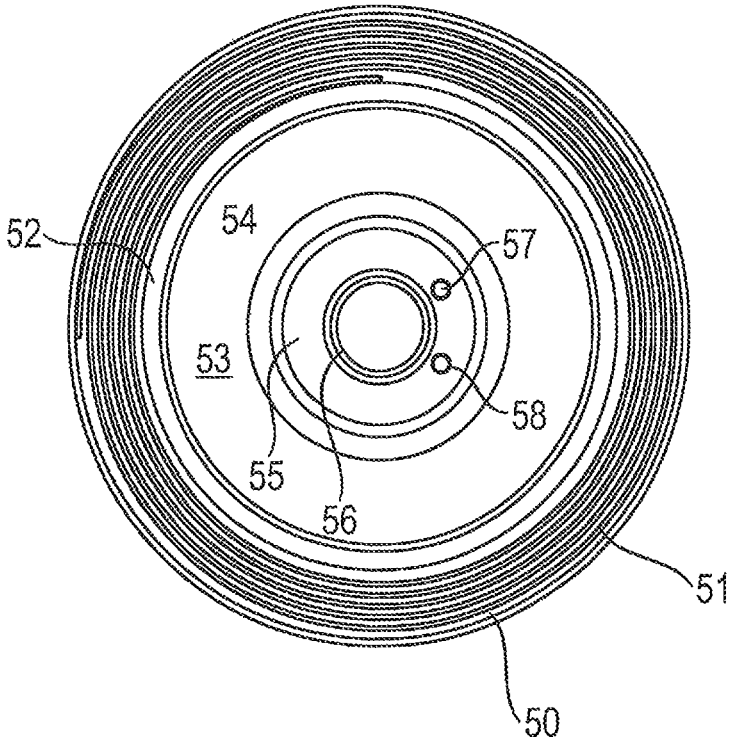
FIG. 13: the same drinking straw holder in a bottom view.

According to FIGS. 12 and 13, a drinking straw holder 49 has a circular ring disk-shaped ring flange 50 with a spiral ventilation channel 51 on the bottom side. The ventilation channel 51 is a groove in the bottom side of the ring flange 50.

A sleeve-like edge section 52 of a bottom wall 53 is connected with the inner edge of the ring flange 50. The edge section 52 is connected with a dome-shaped middle section 54. The middle section 54 is in turn connected with a conical central section 55, which carries a sleeve-like holding section 56. Two axial ventilation holes 57, 58 are present in the conical central section right next to the holding section 56.

From the top side of the bottom wall 53, a sleeve-like support section 57 protrudes upwards in the connection area from the middle section 54 and central section 55.

Figure 14:
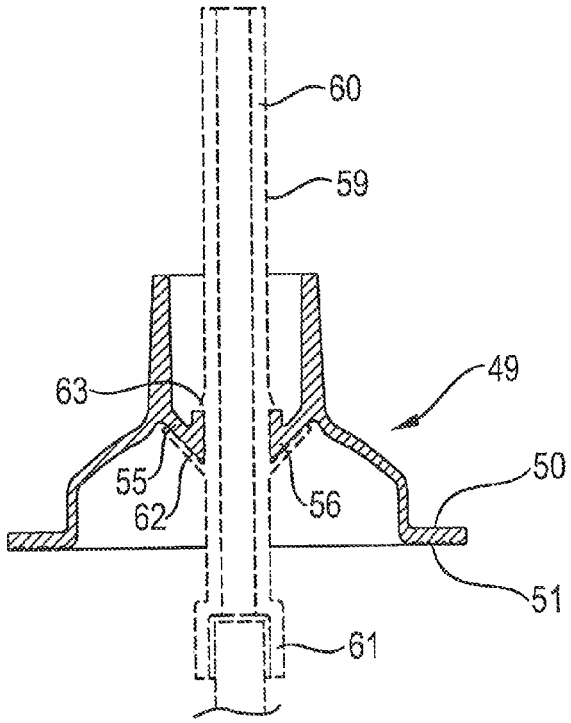
FIG. 14: the same drinking straw holder with inserted drinking straw in a vertical cut.

According to FIG. 14, an upper part of a drinking straw 59 is held in the drinking straw holder 49. It has a tube body 60 with a widening 61 on the bottom end. Above this, the bottom part of the drinking straw 59 has a conical, upwards expanding flange 62. Above the flange, a small conical section 63 is present on the casing of the tube body 60, the bottom side of which forms a stop.

The upper part of the drinking straw 59 is inserted into the holding section 56 from below, wherein the conical section 63 is pushed through the holding section 56 until the stop rests on the top side of the holding section 56. The conical flange 62 simultaneously lies on the bottom side of the central section 55. The upper part of the drinking straw 59 is produced as one piece from silicone or another soft elastic material.

A tubular bottom part of the drinking straw 59, which protrudes up to just before the bottom of a drinking vessel, is clampable in the widening 61.

The drinking straw holder 49 can be placed on the opening edge 11 of the drinking vessel 1 in FIG. 1 and fixed to it by means of the threaded ring 3. The bottom part of the drinking straw 59 is to be measured such that it protrudes downwards up to just before the bottle bottom 6. The user can remove the beverage from the drinking vessel 1 by sucking on the outwardly protruding part of the drinking straw 59. The elasticity of the upper part of the drinking straw 59 hereby permits different orientations of the drinking bottle 1. Air can flow in from outside through the ventilation channel 51, which is formed between the ring flange 50 and the opening edge 11. The cap 4 is clamped on the threaded ring 3 for liquid-tight closure. The uppermost part of the drinking straw 59 is hereby bent over the upper edge of the support section 57 and a sealing of the drinking straw 59 is hereby achieved.

A further ventilation is brought about by the conical flange 62, which rises from the central section 55 and opens the ventilation holes, 57, 58 in the case of increased negative pressure in the inner space 13 of the drinking vessel 1. This ventilation is used in conventional drinking straw holders. It has the disadvantage that it only opens in the case of relatively high negative pressure. This ventilation can be forgone in the case of the drinking straw according to the invention. The exemplary embodiment shows a conventional drinking straw holder, which was later provided with a ventilation channel 51 in the bottom side of the ring flange 50.

Figure 16:
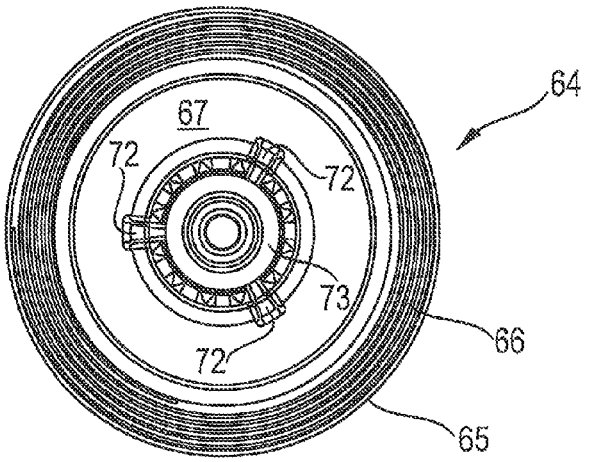
FIG. 16: the same drinking cap without a mouthpiece in a bottom view.
Figure 15:
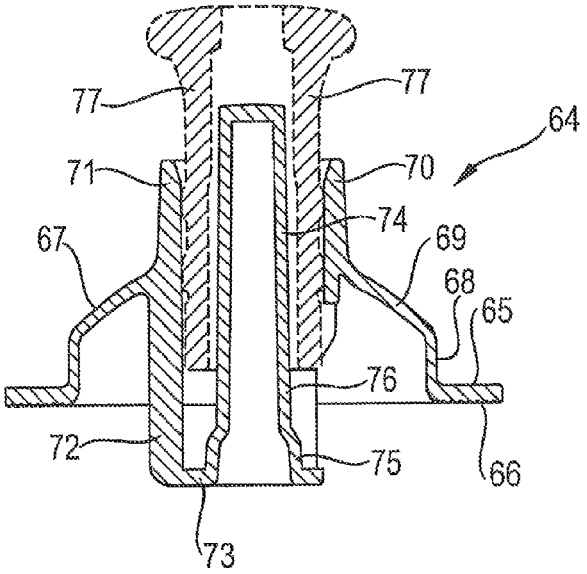
FIG. 15: a push/pull drinking cap in a vertical cut.

FIGS. 15 and 16 show a drinking cap 64 with a push/pull valve. The drinking cap 64 has a ring flange 65 with a spiral ventilation channel 66 on the bottom side. A bottom wall 67 protrudes upwards from the inner edge of the ring flange 65, which has a sleeve-like edge section 68 and a dome-shaped middle area 69.

A mouthpiece holder 70 is located in the center of the bottom wall 67. The mouthpiece holder 70 has a sleeve-like holder section 71, which protrudes upwards from the bottom wall 67. Furthermore, it has three bars 72 protruding downwards from the bottom side of the bottom wall. The bars 72 are interconnected on the bottom by a circular ring-like disk 73. A pin 74 protrudes upwards from the center of the disk 73. The pin 74 has a wider lower pin section 75 and a narrower upper pin section 76.

A mainly hollow and cylindrical mouthpiece 77 is inserted into the mouthpiece holder 70 from above and is displaceable along the pin 74 upwards into an open position and downwards into a closed position. In the closed position, the lower end of the mouthpiece 77 is sealed on the expanded lower pin section 75 of the pin 74.

The mouthpiece 77 is sealed on the outer circumference with respect to the inner circumference of the holder section 71.

In the open position, liquid can get into the ring gap between mouthpiece 77 and pin 74 through the bars 72 and can escape to the outside through the central passage hole of the mouthpiece 77.

This push/pull closure is described in the German patent application DE 10 2012 002 935. This patent application is included in the present application by means of reference. Only the ventilation channel 66 on the ring flange 65 is not known from the older patent application.

The push/pull drinking cap 64 is fixable on a vessel 1 in FIG. 1 by means of the threaded ring 3. The mouthpiece 77 is brought into the open position for drinking. During drinking, a pressure equalization takes place through the ventilation channel 66 between ring flange 65 and the opening edge of the drinking vessel 1. If the mouthpiece 77 is in the closed position, no liquid can escape. The ventilation channel 66 prevents liquid from flowing out inadvertently, even when the drinking container tips over.

This completes the description of the preferred and alternate embodiments of the invention. Those skilled in the art may recognize other equivalents to the specific embodiment described herein which equivalents are intended to be encompassed by the claims attached hereto.

What is claimed is:

1. A drinking container with a drinking vessel, a drinking cap and a threaded ring, wherein:

the drinking vessel has an inner space (13), a circular vessel opening (10), an opening edge (11), the opening edge including a top side, said opening edge surrounding the vessel opening and an external thread (12) next to the vessel opening, the drinking cap (2; 41; 49; 64) has a bottom wall (15; 44; 53; 67), a ring flange (14; 42; 50; 65), said ring flange including a bottom side, said ring flange surrounding the bottom wall for abutment on the opening edge of the drinking vessel, a drinking element (18; 46; 53; 77) protruding outwards from the bottom wall and a sealing means (27; 47; 48; 59; 4; 74; 77) for sealing and opening a passage from the inner space (13) to an outside of a mouthpiece, which is openable for drinking and otherwise closable, a ventilation channel (34; 43; 51; 66) is present in the bottom side of the ring flange (14; 42; 50; 65) or in the top side of the opening edge (11), which extends from an inner channel opening (40.1) lying further inside radially and open towards the inner space (13) of the drinking vessel (1) up to an outer channel opening (40.2) lying further outside radially and open to the environment, surrounds the center of the vessel opening (10) at least 0.75-fold between these two channel openings, has a cross-sectional surface in the range of 0.02 to 0.08 $mm^2$ and is designed in a rigid material with a modulus of elasticity of at least 0.2 $kN/mm^2$, and the ring flange (14; 42; 50; 65) is fixable in liquid-tight abutment on the opening edge (11) by means of the threaded ring.

2. The drinking container according to claim 1, in which the ventilation channel (34; 43; 51; 66) progresses in the circumferential direction around the center of the ring flange (14; 42; 50; 65) at least one time.

3. The drinking container according to claim 1, in which the ventilation channel (34; 41; 51; 66) has a cross-sectional surface in the range of 0.03-0.06 mm.

4. The drinking container according to claim 1, in which the cross-sectional surface of the ventilation channel (34; 43; 51; 66) has the same size everywhere.

5. The drinking container according to claim 1, in which the ventilation channel (34; 43; 51; 66) has a spiral or a meandering progression around the center of the vessel opening (10).

6. The drinking container according to claim 1, in which the ventilation channel (34; 43; 51; 66) has a depth of 0.1-0.25 mm.

7. The drinking container according to claim 1, in which the ventilation channel (34; 43; 51; 66) has a width of 0.35-0.55 mm.

8. The drinking container according to claim 5, in which the carrying region between two neighboring channel sections of the ventilation channel (34; 43; 51; 66) has a width of at least 0.2 mm.

9. The drinking container according to claim 1, in which the opening edge (11) has a width of 0.8-2.5 mm.

10. The drinking container according to claim 1, in which the opening edge (11) has an outer diameter in the range of 30 to 70 mm.

11. The drinking container according to claim 1, in which the bottom side of the ring flange (14; 42; 50; 65) and/or the top side of the opening edge (11) has a roughness, which prevents or reduced the capillary action in the case of dish-washing-liquid-containing wetting.

12. The drinking container according to claim 1, in which the ring flange (14; 42; 50; 65) and the opening edge (11) are circular disk-shaped or conical or spherical shell-shaped.

13. The drinking container according to claim 1, in which the ventilation channel (34; 43; 51; 66) is integrated directly into the bottom side of the ring flange (14; 42; 50; 65) connected as one piece with the bottom wall (15; 44; 53; 67) or is integrated into the bottom side of a separate ring flange, which is clampable between the ring flange connected as one piece with the bottom wall and the opening edge or in which the ventilation channel (14; 43; 51; 66) is integrated directly into the top side of the opening edge connected as one piece with the drinking vessel or is integrated into the top side of a separate, ring disk-shaped opening edge, which is clampable between the opening edge (11) connected as one piece with the drinking vessel and the ring flange (14; 42; 50; 65).

14. The drinking container according to claim 1, in which the drinking vessel (1) is a drinking bottle or a drinking cup and/or the drinking cap (2) is a drinking spout or a drinking cap with a push/pull valve or a drinking cap with a drinking straw or a drinking suction nozzle.

15. The drinking container according to claim 1, in which the entire drinking vessel (1) and/or at least the ring flange (14; 42; 50; 65) and the bottom wall (15; 44; 53; 67) of the drinking cap (2) consist of the rigid material with the modulus of elasticity of 0.2 $kN/mm^2$.

16. The drinking container according to claim 1, in which the ring flange (14; 42; 50; 65) and/or the opening edge (11) is made of polypropylene or of polyethylene or of polypropylene with additives of thermoplastic elastomer or of another thermoplast or of a vulcanized rubber or of a hard-set thermoplastic elastomer or of metal or of any combination of the named materials.

* * * * *